US006419172B1

(12) United States Patent
Yamazaki et al.

(10) Patent No.: US 6,419,172 B1
(45) Date of Patent: Jul. 16, 2002

(54) MOBILE CRUSHER

(75) Inventors: Kazuyuki Yamazaki, Kawasaki; Satoru Koyanagi, Tokyo; Yasutaka Nishida; Katsuhiro Ikegami, both of Kawasaki; Tooru Nakayama, Kamakura; Motoki Kurohara, Hirakata, all of (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/646,685

(22) PCT Filed: Mar. 18, 1999

(86) PCT No.: PCT/JP99/01360

§ 371 (c)(1),
(2), (4) Date: Sep. 20, 2000

(87) PCT Pub. No.: WO99/48610

PCT Pub. Date: Sep. 30, 1999

(30) Foreign Application Priority Data

Mar. 20, 1998 (JP) ..... 10-092798

(51) Int. Cl.[7] ..... A02C 25/00

(52) U.S. Cl. ..... 241/34; 241/101.71

(58) Field of Search ..... 241/34, 36, 101.71, 241/101.74, 101.76

(56) References Cited

FOREIGN PATENT DOCUMENTS

| | | |
|---|---|---|
| JP | 62-027746 | 2/1987 |
| JP | 05-001315 | 1/1993 |
| JP | 07-116541 | 5/1995 |
| JP | 08-281140 | 10/1996 |

*Primary Examiner*—Mark Rosenbaum
(74) *Attorney, Agent, or Firm*—Sidley Austin Brown & Wood LLP

(57) ABSTRACT

A mobile crusher, which has a high-quality controlling function enabling an efficient production, and which is capable of preventing the crusher itself from being damaged, is provided. For this purpose, a mobile crusher having a feeder (3) and a crusher member (4) which are set drivably on a mobile vehicle body (1), includes means (7) for detecting an amount of a material to be crushed, which detects an amount (H) of a material (6*a*) to be crushed inside the crusher member (4), and control means (10) for receiving the amount H from the means (7) for detecting the amount of the material to be crushed and controlling a driving speed V of the feeder (3) changeably based on the reception amount H.

4 Claims, 8 Drawing Sheets

| H | FEEDER SPEED V (DRIVING CURRENT I) |
|---|---|
| $H \leqq H_L$ | INCREASE SPEED $V_2 + \Delta V$ $(I_2 + \Delta I)$ |
| $H_L < H < H_H$ | MAINTAIN SPEED $V_2$ $(I_2)$ |
| $H \geqq H_H$ | REDUCE SPEED $V_2 - \Delta V$ $(I_2 - \Delta I)$ |

FIG. 8

| $A_2-B$ | C | $A_2-B+C$ ($C=+C \sim -C$) | | FEEDER SPEED V (DRIVING CURRENT I) | |
|---|---|---|---|---|---|
| $+(A_2>B)$ | +C | + | $A_2-B+C>0$ | INCREASE SPEED | $V_2+\Delta V_0$ ($I_2+\Delta I_0$) |
| | C=0 | + | | | |
| | -C | + | | | |
| | | 0 | $A_2-B+C=0$ | MAINTAIN SPEED | $V_2$ ($I_2$) |
| | | - | $A_2-B+C<0$ | REDUCE SPEED | $V_2-\Delta V_0$ ($I_2-\Delta I_0$) |
| $0(A_2=B)$ | +C | + | $A_2-B+C>0$ | INCREASE SPEED | $V_2+\Delta V_0$ ($I_2+\Delta I_0$) |
| | C=0 | 0 | $A_2-B+C=0$ | MAINTAIN SPEED | $V_2$ ($I_2$) |
| | -C | - | $A_2-B+C<0$ | REDUCE SPEED | $V_2-\Delta V_0$ ($I_2-\Delta I_0$) |
| $-(A_2<B)$ | +C | + | $A_2-B+C>0$ | INCREASE SPEED | $V_2+\Delta V_0$ ($I_2+\Delta I_0$) |
| | | 0 | $A_2-B+C=0$ | MAINTAIN SPEED | $V_2$ ($I_2$) |
| | | - | $A_2-B+C<0$ | REDUCE SPEED | $V_2-\Delta V_0$ ($I_2-\Delta I_0$) |
| | C=0 | - | | | |
| | -C | - | | | |

FIG. 1 0

| H | $A_2$-B | FEEDER SPEED V (DRIVING CURRENT I) |
|---|---|---|
| $H \leqq H_L$ | | INCREASE SPEED $V_2+\Delta V_1$ $(I_2+\Delta I_1)$ |
| $H_L<H<H_H$ | + ($A_2>B$) | INCREASE SPEED $V_2+\Delta V_2$ $(I_2+\Delta I_2)$ |
| | 0 ($A_2=B$) | MAINTAIN SPEED $V_2$ $(I_2)$ |
| | - ($A_2<B$) | REDUCE SPEED $V_2-\Delta V_2$ $(I_2-\Delta I_2)$ |
| $H \geqq H_H$ | | REDUCE SPEED $V_2-\Delta V_1$ $(I_2-\Delta I_1)$ |

FIG. 1 1 PRIOR ART
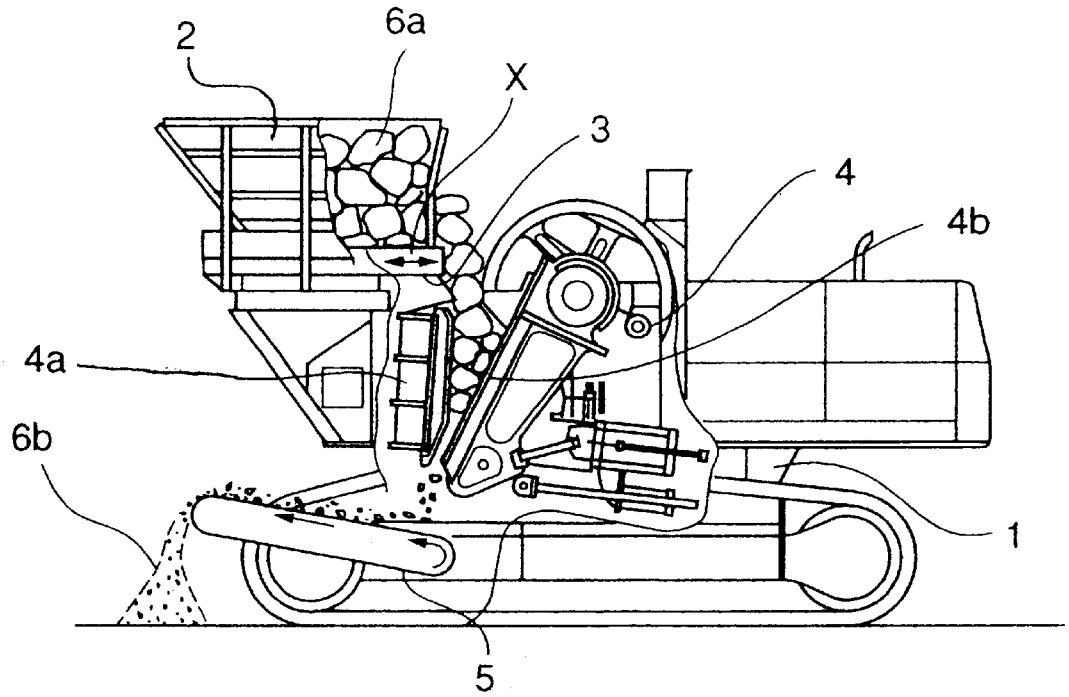
FIG. 1 2 PRIOR ART
| A2-B | FEEDER SPEED V |
|---|---|
| + (A2>B) | INCREASE SPEED V2+ΔV |
| 0 (A2=B) | MAINTAIN SPEED V2 |
| - (A2<B) | REDUCE SPEED V2-ΔV |

MOBILE CRUSHER

TECHNICAL FIELD

The present invention relates to a crusher provided on a mobile vehicle body.

BACKGROUND ART

As an example is shown in FIG. 11, a mobile crusher has a hopper 2 provided on a mobile vehicle body 1, a feeder 3 provided at a bottom portion of the hopper 2, a crusher member 4 provided under an end portion of the feeder 3, a belt conveyor 5 provided under the crusher member 4, and the like. The feeder 3, the crusher member 4, and the belt conveyor 5 are driven by a feeder driving system, a crusher driving system, and a belt conveyor driving system (each not illustrated). An upper portion of the crusher member 4 is opened and faces to the end portion of the feeder 3, and a lower portion of the crusher member 4 is opened and faces to a top surface of the belt conveyor 5. According to the above configuration, a material 6*a* to be crushed, which is placed on the feeder 3 from the outside, is fed into the crusher member 4 from the upper opening of the crusher member 4 by the drive of the feeder 3, and is crushed by the drive of the crusher member 4. A crushed material 6*b* is discharged onto the belt conveyor 5 from the lower opening of the crusher member 4 and is discharged out of the vehicle by the drive of the belt conveyor 5, as a product.

In the above mobile crusher, a synchronous control of the aforementioned three driving systems has a profound effect on the productivity of the crushed material 6*b*. Thus, some crushers have target crushing amount setting means (not illustrated) for inputting a target crushing amount A2 per unit time of the crusher 4, and actual crushing amount detecting means (not illustrated) for detecting an actual crushing amount B per unit time of the crusher 4. The crusher further has control means for comparing the target crushing amount A2 and the actual crushing amount B, then as shown in FIG. 12, increasing the speed of the feeder 3 when "A2−B>0", maintaining a driving speed V of the feeder 3 when "A2−B=0", and decreasing the speed when "A2−B<0". It should be noted that "A2" has a predetermined range. Further, the following crushers are known.

(1)A crusher described in Japanese Utility Model Laid-open No. 5-1315 is a stationary type, which has a sensor for detecting a rock when the large rock stays on a grizzly screen provided at the upper opening of the crusher, and a controlling device for automatically stopping the feeder when the sensor detects the rock for a predetermined time.

(2) A mobile crusher described in Japanese Patent Laid-open No. 7-116541 has a sensor for detecting overloading when a crusher is under over load, and a controlling device for automatically stopping the feeder when the sensor detects the overloading.

(3) A mobile crusher described in Japanese Patent Laid-open No. 8-281140 has a sensor for detecting an anomaly when the anomaly occurs at each component (including not only the feeder driving system, crusher driving system, and the belt conveyor driving system, but also an engine, a water temperature in a generator and the like, oil hydraulic pressure, residual amount of fuel, and the like), and a controlling device for automatically stopping the feeder when the sensor detects an anomaly.

According to the above prior arts, though they respectively contribute to productivity improvements, they have the following disadvantages.

(1) Though the details are described later, the actual crushing amount B directly depends on the amount of the material 6*a* to be crushed inside the crusher member 4 from the view of the placement position of the crusher member 4 and from the view of the crushing efficiency of the crusher member 4. In spite of this, in the above conventional crusher, specifically, the crusher, which changes the driving speed V of the feeder 3 based on the comparison result between the target crushing amount A2 and the actual crushing amount B, the detection result of the actual crushing amount detecting means provided at a downstream side of the crusher member 4 is reflected in the driving speed V of the feeder 3 provided at an upstream side of the crushing member 4. As a result, a lag inevitably occurs in the synchronization between the actual crushing amount B and the driving speed V of the feeder 3. Thereby the disadvantage that the control of high quality is not obtained is caused.

(2) In the crusher described in each of the aforementioned Official Gazettes, the feeder automatically stops when an anomaly occurs. Specifically, these prior arts are control arts when an anomaly occurs. Thus, the disadvantage occurs, in which, for example, a damage to the crusher itself and reduction of productivity are caused.

DISCLOSURE OF THE INVENTION

In view of the aforementioned prior arts, an object of the present invention is to provide a mobile crusher which has a high-quality controlling function enabling efficient production, and which is capable of preventing the crusher itself and the like from being damaged, by preventing the occurrence of an anomaly.

The mobile crusher according to the present invention is made especially in view of the above "the actual crushing amount B directly depends on the amount of the material 6*a* to be crushed inside the crusher member 4". This will be explained with reference to a jaw crusher in FIG. 1A to FIG. 3.

A jaw crusher 4 is one which is also placed on the example machine in FIG. 11, and as shown in FIG. 1A, FIG. 2A and FIG. 3, a stationary plate 4a and a swing jaw 4*b* are adjustably placed to face to each other with an upper opening being large and a lower opening being small. A material 6*a* to be crushed is fed into a portion between the stationary plate 4*a* and the swing jaw 4*b* facing to each other (being the aforementioned "an inside of the crusher member 4", and a so-called "crushing chamber"). A grain diameter of a crushed material 6*b* is determined by the dimension of the lower opening.

[1] As shown in FIG. 1A, the stationary plate 4*a* is fixed to a vehicle body (not illustrated), but an upper end of the swing jaw 4*b* is rotationally driven by an eccentric driving shaft 4*c*, and a lower end thereof is freely supported by the vehicle body via a plate 4*d*. Specifically, as shown in a skeleton drawing of linkage in FIG. 1B, the movement of the swing jaw 4*b* approaches a linear movement a3 as a circular movement a1 at an upper portion by the eccentric driving shaft 4*c* proceeds to a lower portion. Accordingly, a crushing force $F_0$ per one rotation of the eccentric driving shaft 4*c* produced by the swing jaw 4*b* (specifically, the force $F_0$ in a vertical direction to the stationary plate 4*a*) is distributed as shown in FIG. 1C.

[2] Assume that stones from a small stone (small material to be crushed) 6*a* to a large stone (large material to be crushed) 6*a* are orderly fed into the inside of the crusher member 4 from the small lower portion toward the large upper portion as shown in FIG. 2A. In this situation, a crushing force F1 required for crushing each stone 6*a* is distributed as shown in FIG. 2B. When the distribution (FIG. 2B) of the required crushing force F1 is overlaid on the distribution of the crushing force $F_0$ produced by the swing jaw 4*b* in FIG. 1C, FIG. 2C is obtained. FIG. 2C shows that when a height H of the material 6*a* to be crushed inside the crusher member 4 is large, the material 6*a* to be crushed cannot be efficiently crushed. It should be noted that the amount of the material 6*a* to be crushed inside the crusher member 4 is equivalent to the height H (the same shall apply hereinafter).

[3] Assume that small stones 6*a* are fed into the inside of the crusher member 4 to fill the same as shown in FIG. 3. In this situation, the stones 6*a* from the center to the lower portion of the crusher member 4 directly receive the crushing force $F_0$ and are crushed, since the crushing movement in this area gradually approaches the linear movement a3 (See FIG. 1B), and thus the power loss is small. However, as for the stones 6*a* at the upper portion of the crusher member 4, since the crushing movement in this area is the circular movement a1, the crushing force $F_0$ has the components changing into the rotational movement of each stone 6*a* itself, and the frictional force between the stones 6*a*, and thus the expected crushing cannot be acheived. Specifically, not only the power loss occurs to the stones 6*a* at the upper portion of the crusher member 4, but also the wear of the upper portions of the stationary plate 4*a* and the swing jaw 4*b* is promoted.

[4] As is obvious from the explanations in the above [2] and [3], the height H of the material 6*a* to be crushed inside the crusher member 4 is basically desired to be the height which does not include the upper portion of the inside of the crusher member 4 for efficiency of the crusher member 4 (hereinafter, the upper limit height H is called "height HH". See FIG. 2C).

[5] The actual crushing amount B is an absolute amount, and is not related to the efficiency of the crusher member 4. Consequently, even if the crushing efficiency is favorable in view of the crushing force $F_0$ of the c rusher member 4, if the crushing amount B is actually small, it is meaningless. Specifically, based on the above explanations [2] and [3], if the height H of the material 6*a* to be crushed inside the crusher member 4 is set at the lower portion of the crusher member 4, it frequently happens that the material 6*a* to be crushed does not exist inside the crusher member 4. Since the crushed material 6*b* falls as a result of being pressed by the weight of itself and the weight of the material 6*a* to be crushed at the upper portion, if the material 6*a* to be crushed doesn't exist at the upper portion, control of the producing speed or the like becomes difficult. Specifically, the height H of the material 6*a* to be crushed inside the crusher 4 is desired to be basically the height which doesn't include the lower portion inside the crusher member 4 if the actual crushing amount B is considered (Hereinafter, the lower limit height H is called "the height HL". See FIG. 2C).

[6] According to the above [4] and [5], in point of efficiency of the crusher member 4, and in point of the actual crushing amount B, it can be understood that the height H of the material 6*a* to be crushed inside the crusher 4 is desired to be set as "HL<H<HH" (See FIG. 2C). "HL" in the embodiments described later is set to be about one third of the height of the inside of the crusher member 4, and "HH" is set to be about two thirds of the height.

[7] As for the crusher member 4, other than the above jaw crusher, various kinds of crusher members such as, for example, an impact type, shear type and the like are prepared. The impact type has a rotary plate and a crushed material discharge port at a lower portion of a crushing chamber, and a repulsion plate and an input port for the material to be crushed at an upper portion, and is the type in which the material to be crushed from the input port is repulsed by the rotary plate, is smashed to the repulsion plate to be crushed, and is discharged from the discharge port. The shear type is the type in which the material to be crushed is fed into a portion between rollers rotating reversely to each other separated by a predetermined distance to be crushed, and is discharged from the lower portion. The conclusion of the above [6] (HL<H<HH) is also applicable to these impact type, the shear type and the like of crusher member 4 by detecting the height H of the material 6*a* to be crushed inside the crusher member 4.

In order to attain the aforementioned object, a first aspect of a mobile crusher according to the present invention is a mobile crusher including a feeder and a crusher member each set drivably on a mobile vehicle body, which feeds a material to be crushed, which is placed on the feeder from an outside, into an inside of the crusher member from an upper opening of the crusher member by drive of the feeder, crushes the same by drive of the crusher member, and discharges a crushed material from a lower opening of the crusher member to the outside, and is characterized by including:

(a) means for detecting an amount of a material to be crushed, which detects an amount H of the material to be crushed inside said crusher member; and (b) control means for receiving the amount H from the means for detecting the amount of the material to be crushed and controlling a driving speed V of the feeder changeably based on the reception amount H.

According to the aforementioned first configuration, since the driving speed V of the feeder is directly controlled according to the amount H of the material to be crushed, occurrence of an anomaly can be prevented, and thus the crusher itself or the like can be prevented from being damaged. The quality of the control of the actual crushing amount B is improved, thus making it possible to efficiently produce the crushed objects.

A second aspect is a mobile crusher including a feeder and a crusher member each set drivably on a mobile vehicle body, which feeds a material to be crushed, which is placed on the feeder from an outside, into an inside of the crusher member from an upper opening of the crusher member by drive of the feeder, crushes the same by drive of the crusher member, and discharges a crushed material from a lower opening of the crusher member to the outside, and is characterized by including:

(a) means for detecting an amount of a material to be crushed, which detects an amount H of the material to be crushed inside the crusher member; and (b) control means for previously memorizing reference values HL and HH (note that "HL<HH"), receiving the amount H from the means for detecting the amount of the material to be crushed, comparing the amount H with the reference values HL and HH, and (b1) when "H<HL", inputting a signal +ΔI to increase a driving speed V of the feeder to a feeder driving system, (b2) when "HL<H<HH", inputting a signal I2 to maintain the driving speed V to the feeder driving system, and (b3) when "H≧HH", inputting a signal −ΔI to decrease the driving speed V to the feeder driving system.

The above second configuration is a result of embodying the above first configuration further in detail, and the result is as shown, for example, in the control result in FIG. 6. Specifically, the height H of the material to be crushed inside the crusher member is basically maintained to be "HL<H<HH". As a result, the most preferable mode is achieved in terms of the efficiency of the crusher member and the actual crushing amount B.

A third aspect is a mobile crusher including a feeder and a crusher member each set drivably on a mobile vehicle body, which feeds a material to be crushed, which is placed on the feeder from an outside, into an inside of the crusher member from an upper opening of the crusher member by drive of the feeder, crushes the same by drive of the crusher member, and discharges a crushed material from a lower opening of the crusher member to the outside, and is characterized by including:

(a) target crushing amount setting means for setting a target crushing amount A2 per unit time of the crusher member;

(b) actual crushing amount detecting means for detecting an actual crushing amount B per unit time of the crusher member;

(c) means for detecting an amount of a material to be crushed, which detects an amount H of the material to be crushed inside the crusher member; and (d) control means for receiving a target crushing amount A2 from the target crushing amount setting means, an actual crushing amount B from the actual crushing amount detecting means, and the amount H from the means for detecting the amount of the material to be crushed, and controlling a driving speed V of the feeder changeably based on the reception amounts A2, B and H.

According to the above third configuration, in the mobile crusher having the target crushing amount setting means for setting the target crushing amount A2 per unit time of the crusher member, and the actual crushing amount detecting means for detecting the actual crushing amount B per unit time of the crusher member, in addition to the basic operational effects of maintaining "HL<H<HH" in the first and second configuration, the operational effect of rapid convergence on "B=A2" is provided.

A fourth aspect is a mobile crusher including a feeder and a crusher member each set drivably on a mobile vehicle body, which feeds a material to be crushed, which is placed on the feeder from an outside, into an inside of the crusher member from an upper opening of the crusher member by drive of the feeder, crushes the same by drive of the crusher member, and discharges a crushed material from a lower opening of the crusher member to the outside, and is characterized by including:

(a) target crushing amount setting means for setting a target crushing amount A2 per unit time of the crusher member;

(b) actual crushing amount detecting means for detecting an actual crushing amount B per unit time of the crusher member;

(c) means for detecting an amount of a material to be crushed, which detects an amount H of the material to be crushed inside the crusher member; and (d) control means for previously memorizing reference values HML and HMH (note that "HML<HMH"), (d11) a correction amount +C which is set correspondingly to a value not more than the reference value HML, (d12) a correction amount C (=0) which corresponds to a value between the reference values HML and HMH, and (d13) a correction amount −C which is set correspondingly to a value not less than the reference value HMH, receiving a target crushing amount A2 from the target crushing amount setting means, an actual crushing amount B from the actual crushing amount detecting means, and the amount H from the means for detecting the amount of the material to be crushed, (d21) when "H≦HML", reading the aforementioned set correction amount +C, (d22) when "HML<H<HMH", reading the aforementioned corresponding correction amount C (=0), and (d23) when "H≧HMH", reading the aforementioned correction amount −C previously memorized, and computing "A2−B+ the correction amount=D", and (d31) when "D=0", inputting a signal +ΔI0 to increase a driving speed V of the feeder to a feeder driving system, (d32) when "D=0", inputting a signal I2 to maintain the driving speed V to the feeder driving system, and (d33) when "D<0", inputting a signal −ΔI0 to decrease the driving speed V to the feeder driving system.

The above fourth configuration is the configuration in which the above third configuration is embodied further in detail, and the result is as shown in the control result in, for example, FIG. 8. The details are as follows. It should be noted that the reference values HL and HH which are not described in the fourth configuration are described in FIG. 7 as well as the reference values HML and HMH in the fourth configuration. Accordingly, these reference values are also explained below, but since they have the relationship "HL<HML<HMH<HH", if the explanation related to the reference values HL and HH is skipped, it has no effect on the operational effects of the fourth configuration. The reference value HL is the aforementioned lower limit value of the desired height of the material to be crushed inside the crusher member, while the reference value HH is the aforementioned upper limit value of the desired height.

Specifically, since the target crushing amount A2 is an index of the actual crushing amount B which can be attained in the crusher member, even if it changes every moment according to the property of the material to be crushed (B≠A2), if only "optimal control" is performed, it converges on "B=A2" even if some changes (B≠A2) occur. Such "optimal control" is the fourth configuration. The correction amounts from +C to −C may be considered to be the correction for the target crushing amount A2, or may be considered to be the correction amount in computation for the actual crushing amount B. Each mode from the upper row to the lower row in FIG. 8 will be explained in order below.

(1) Since "A2−B>0" is the state in which the actual crushing amount B is smaller than the target crushing amount A2, the driving speed V of the feeder is desired to be increased. In this situation, when "H≦HML", the material to be crushed inside the crusher member is rapidly gone, and crushing movement without the material to be crushed occurs, thus causing noises and a damage to the machine. Accordingly, in this situation, the driving speed V of the feeder is increased.

(2) When "A2−B>0" as in the above, even if "HML<H<HMH (specifically, C=0)", the driving speed V of the feeder is increased as in the above (1).

(3) However, even though "A2−B>0" as in the above, when "H>HMH (specifically, the correction amount −C)", the amount H is close to the upper limit value HH, and therefore if the driving speed V of the feeder is increased, there is the fear of "H>HH". Thereby, the correction amount −C is set. The correction value −C is set so that the negative value gradually increases as the amount H increases. According to the amount of the correction amount −C, three states of "A2−B−C>0", "A2−B−C=0", and "A2−B−C<0" occur. Thus, (3*a*) In "A2−B−C>0", the driving speed V of the feeder is increased as in the above (1).

(3*b*) In "A2−B−C=0", the driving speed V of the feeder is maintained.

(3*c*) In "A2−B−C<0", there is the fear that the upper opening of the crusher member is blocked by the material to be crushed since the amount H is larger than the above (3*b*). Accordingly, the driving speed V of the feeder is decreased. From the above, in consideration of (3*a*) and (3*b*), since it is necessary to establish "H<HH" relative to any value of the A2, it is desirable to set the negative maximum value Cmin of the C to be larger than the maximum value Amax of the target crushing amount A2.

(4) "A2−B=0" is the state in which the actual crushing amount B and the target crushing amount A2 are the same, and it is separated into the three states of "H≦HML (specifically, the correction amount +C)", "HML<H≧HMH (specifically, C=0)", and "H>HMH (specifically, the correction amount −C)" according to the amount of the amount H of the material to be crushed.

(4*a*) Since the correction amount +C shows "H≦HML", the driving speed V of the feeder is increased to achieve "HML<H<HMH (specifically, C=0)".

(4*b*) When "C=0", the driving speed V of the feeder is maintained. It is natural and the explanation is not required.

(4*c*) Since the correction amount −C shows "H>HMH", the driving speed V of the feeder is decreased to achieve "HML<H<HMH (specifically, C=0)", thus preventing the upper opening of the crusher member from being blocked by the material to be crushed.

(5) "A2−B<0" is the state in which the actual crushing amount B is larger than the target crushing amount A2, and thus it is desirable to decrease the driving speed V of the feeder. In this situation, when "H≦HML (specifically, the correction amount +C", it is separated into the three states of "A2−B+C>0", "A2−B+C=0", and "A2−B+C<0".

(5*a*) When "A2−B+C>0", since the actual crushing amount B is large, it is desirable to decrease the driving speed V of the feeder, but the driving speed V of the feeder is increased to increase the feeding amount of the material to be crushed into the crusher member. As a result, a so-called crushing movement without the material to be crushed is prevented.

(5*b*) When "A2−B+C=0", the driving speed V of the feeder is maintained.

(5*c*) When "A2−B+C<0", the driving speed V of the feeder is decreased. From the above, in consideration of (5*b*) and (5*c*), it is necessary to achieve "H>HL" relative to any value of the target crushing amount A2, and therefore it is desirable to set the maximum value Cmax of the C to be larger than the maximum value Bmax of the actual crushing amount B.

(6)When "A2−B<0" as in the above, if "HML<H<HMH (specifically, C=0), the driving speed V of the feeder is increased.

(7) When "A2−B<0" as in the above and when "H≧HMH (specifically, the correction amount −C)", it is desirable to decrease the driving speed V of the feeder since the actual crushing amount B is large, but since the amount of the material to be crushed inside the crusher member is also large, the upper opening of the crusher member is blocked by the material to be crushed according to the property of the material to be crushed. Accordingly, the driving speed V of the feeder is decreased.

Specifically, though the above (1) to (7) are each separately described, in the mobile crusher having the target crushing amount setting means for setting the target crushing amount A2 per unit time of the crusher member, the actual crushing amount detecting means for detecting the actual crushing amount B per unit time of the crusher member, the shift between the modes from the above (1) to (7) is proceeded in order. Thus, in the fourth configuration, the operational effect of rapid convergence on "B=A2" is provided in addition to the basic operational effect of maintaining "HL<H<HH" in the first to the third configuration.

If the correction amount +C in the above fourth configuration is set to be a fixed value and larger than the maximum value of the actual crushing amount B, and the absolute value of the correction amount −C is a fixed value and larger than the target crushing amount A2, in the fourth configuration, (a) when "H≦HML", the driving speed V of the feeder is increased, (b) when "HML<H <HMH", the driving speed V of the feeder is maintained, and (c) when "H≧HMH", the driving speed of the feeder is decreased, thus facilitating the control. This resultant configuration shall be also included in the above fourth configuration.

A fifth configuration is a mobile crusher including a feeder and a crusher member each set drivably on a mobile vehicle body, which feeds a material to be crushed, which is placed on the feeder from an outside, into an inside of the crusher member from an upper opening of the crusher member by drive of the feeder, crushes the same by drive of the crusher member, and discharges a crushed material from a lower opening of the crusher member to the outside, and is characterized by including:

(a) target crushing amount setting means for setting a target crushing amount A2 per unit time of the crusher member;

(b) actual crushing amount detecting means for detecting an actual crushing amount B per unit time of the crusher member;

(c) means for detecting an amount of a material to be crushed, which detects an amount H of the material to be crushed inside the crusher member; and (d) control means for previously memorizing reference values HL and HH (note that "HL<HH"), receiving the target crushing amount A2 from the target crushing amount setting means, the actual crushing amount B from the actual crushing amount detecting means, and the amount H from the means for detecting the amount of the material to be crushed, comparing the amount H with the reference values HL and HH, and (d21) when "H≦HL", inputting a signal +ΔI1 to increase the driving speed V of the feeder to a feeder driving system, (d22) when "HL<H<HH", computing "A2−B=E", and (d221) when "E>0", inputting a signal +ΔI2 to increase the driving speed V to the feeder driving system, (d222) when "E=0", inputting a signal I2 to maintain the driving speed V to the feeder driving system, and (d223) when "E<0", inputting a signal −ΔI2 to decrease the driving speed V to the feeder driving system, and (d23) when "H≧HH", inputting a signal −ΔI1 to decrease the driving speed V to the feeder driving system.

The above fifth configuration is the configuration in which the feature of the correction amounts +C to −C is deleted, and the target crushing amount A2 and the actual crushing amount B are directly introduced. In this manner, the operational effect of rapidly converging on "B=A2" is provided in addition to the basic operational effect of maintaining "HL<H<HH". In the fifth configuration, the reference value is set to be "HL, HH (note that "HL<HH"), but they may be replaced by "HML, HMH (note that HML<HH). This is because they are only the symbols for showing the dimensional relationship.

BRIEF DESCRIPTION OF THE DRAWINGS

FIG. 1A is a side view of an entire body;

FIG. 1B is a skeleton view of drive of a swing jaw; and

FIG. 1C is a distribution diagram of generating crushing power;

FIG. 2A is a side view of an entire body;

FIG. 2B is a distribution diagram of required crushing force; and

FIG. 2C is a superimposed diagram of a distribution of required crushing force and the distribution of generating crushing force;

FIG. 8 is a diagram showing a control result of a driving speed of a feeder in the second embodiment of the present invention;

FIG. 10 is a diagram showing a control result of a driving speed of a feeder in the third embodiment of the present invention;

FIG. 11 is a side view of a mobile crusher of a prior art; and

FIG. 12 is a diagram showing a result example of a control of a conventional driving speed of a feeder.

BEST MODE FOR CARRYING OUT THE INVENTION

Preferred embodiments of the present invention will be explained with reference to FIG. 4 to FIG. 10. Example machines being a first, second, third embodiments are mobile crushers loaded with jaw crushers as in FIG. 11, and identical elements are given the same numerals and symbols and the explanation thereof will be omitted.

Figure 4:
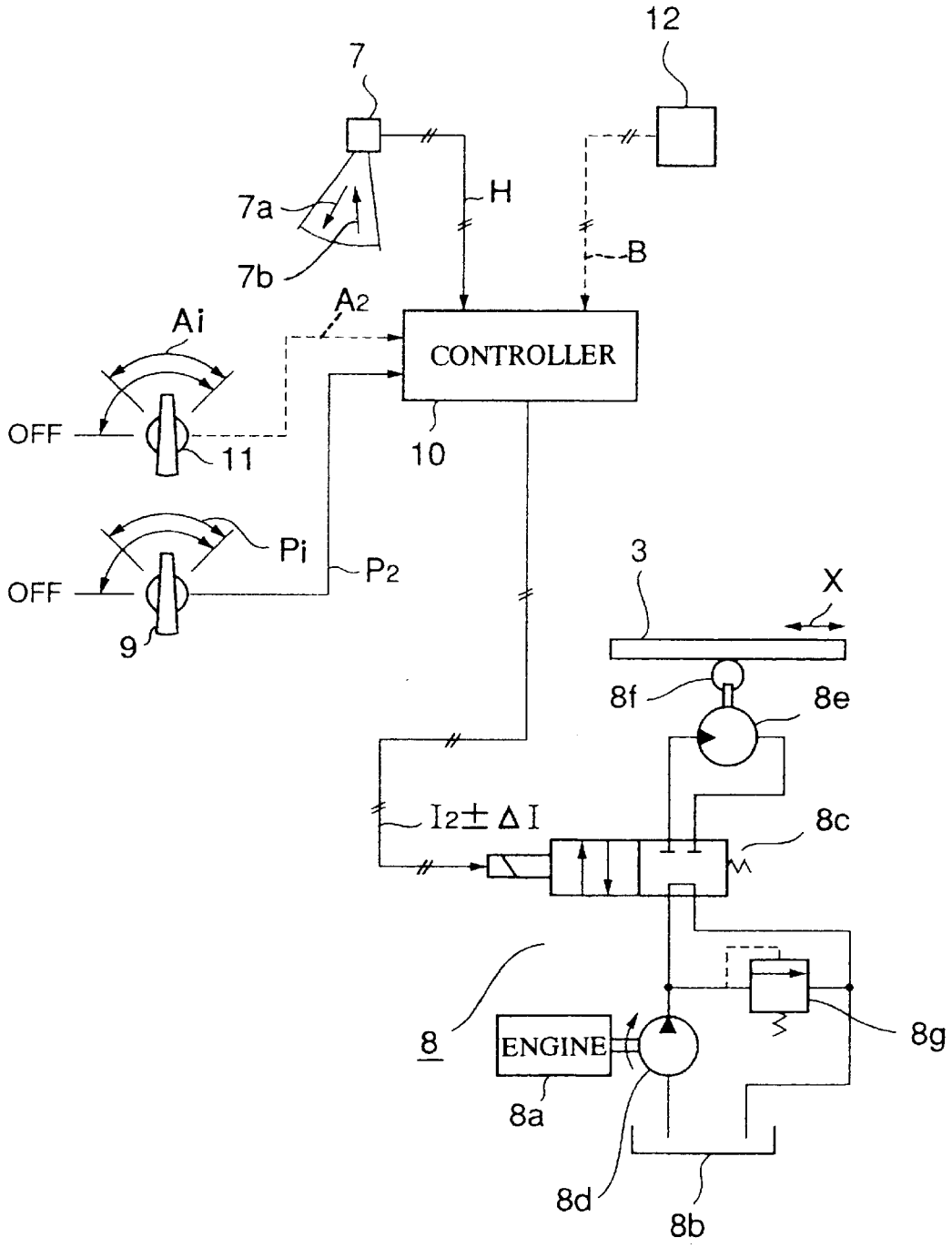
FIG. 4 is a control block diagram of a configuration including a first to a third embodiment of the present invention.

The example machine being the first embodiment has a control system shown by the solid line in FIG. 4. Specifically, it has means 7 for detecting an amount of a material to be crushed (a detector for detecting an amount of a material to be crushed), a feeder driving system 8, a feeder reference speed setting dial 9, and a controller (control means) 10 electrically connecting with them. The details are as follows.

The detector 7 for detecting the amount of the material to be crushed is provided above an upper opening of a crusher member 4, emits an ultrasonic wave 7*a* toward an inside of the crusher member 4, receives a reflected wave 7*b* from a material 6*a* (not illustrated) to be crushed inside the crusher member 4, detects a height H (specifically "an amount H", hereinafter called the same) of the material 6*a* to be crushed inside the crusher member 4, and inputs the same to the controller 10. It should be noted that the detector 7 for detecting the material to be crushed is placed at a position in which the ultrasound wave 7*a* is hard to be emitted to the material 6*a* to be crushed which is falling from the feeder 3 into the crusher member 4.

The feeder driving system 8 has a hydraulic pump 8*d* which is driven by an engine 8*a* loaded on the example machine to supply operating hydraulic fluid from an operating hydraulic fluid tank 8*b* to an electromagnetic proportional valve 8*c*. A hydraulic motor 8*e* is placed at a downstream side of the electromagnetic proportional valve 8*c*, and receives pressure oil from the electromagnetic proportional valve 8*c* to be rotatable. A rotating shaft of the hydraulic motor 8*e* is mechanically coupled to the feeder 3 via an eccentric shaft 8*f*, and the feeder 3 is driven in an X direction by the rotation of the eccentric shaft 8*f*. A relief valve 8*g* for specifying a maximum hydraulic pressure of the entire hydraulic circuit is provided between the electromagnetic proportional valve 8*c* and the hydraulic pump 8*d*. The electromagnetic proportional valve 8*c* receives a driving current I from the controller 10 to be switchable from a closed position (right position in FIG. 4) to an open position (left position in FIG. 4), and has an amount of opening proportional to the magnitude of the driving current I.

The feeder reference speed setting dial 9 has a feeder stopping position OFF and a non-step position Pi from low speed to high speed, and is made switchable by manipulation of an operator. The feeder reference speed setting dial 9 inputs nothing to the controller 10 at the stopping position OFF, while at the non-step position Pi, it inputs a positional signal Pi (for example, a position P2) corresponding to its position.

The controller 10 previously memorizes a reference driving current Ii corresponding to the positional signal Pi. Accordingly, when receiving a positional signal P2, it reads out a reference driving current I2 corresponding thereto from the memory and outputs the same as a driving current I2 to the electromagnetic proportional valve 8*c* (I=I2). As a result, the electromagnetic proportional valve 8*c* is opened with the amount of opening corresponding to the reference driving current I2, and drives the feeder 3 in the X direction at a driving speed V2. Ditto for the other positional signals Pi. Hereinafter, in order to simplify the explanation, it is assumed that the feeder reference speed setting dial 9 is in the position P2 and that the positional signal P2 is inputted to the controller 10 as described above.

As described above, the controller 10 receives the height H of the material 6*a* to be crushed inside the crusher member 4 from the detector 7 for detecting the amount of the material to be crushed. Then the controller 10 adds or subtracts ±ΔI to or from the reference driving current I2 based on a flowchart in FIG. 5, and thereby adds or subtracts ±ΔV to or from the driving speed V2 of the feeder. Details will be subsequently explained with reference to FIG. 5. Though some steps are already explained, they will be described step by step.

When the controller 10 receives the positional signal P2 (step S1), it computes the reference driving current I2 (step S2). The controller 10 receives input of the height H of the material 6*a* to be crushed inside the crusher member 4 from the detector 7 for detecting the amount of the material to be crushed (step S3). The controller 10 previously memorizes a relationship between the height H and the magnitude of the current ±ΔI by means of a function, a matrix and the like. In the concrete examples in FIG. 5, the controller 10 memorizes two large and small reference values HL and HH (HL<HH), the current +ΔI which gradually increases as the height H becomes lower when "H≧HL", and −ΔI which gradually increases as the height H becomes larger when "H≧HH". It should be noted that the current ±ΔI may be a fixed value. The reference value HL corresponds to the aforementioned height HL, and is about one third of the entire height of the inside of the crusher member 4 in concrete. Meanwhile, the reference value HH corresponds to the aforementioned height HH, and is about two thirds of the entire height of the inside of the crusher 4 in concrete (step S4). The controller 10 compares the height H with the reference values HL and HH (step S5).

Figures 5, 6:
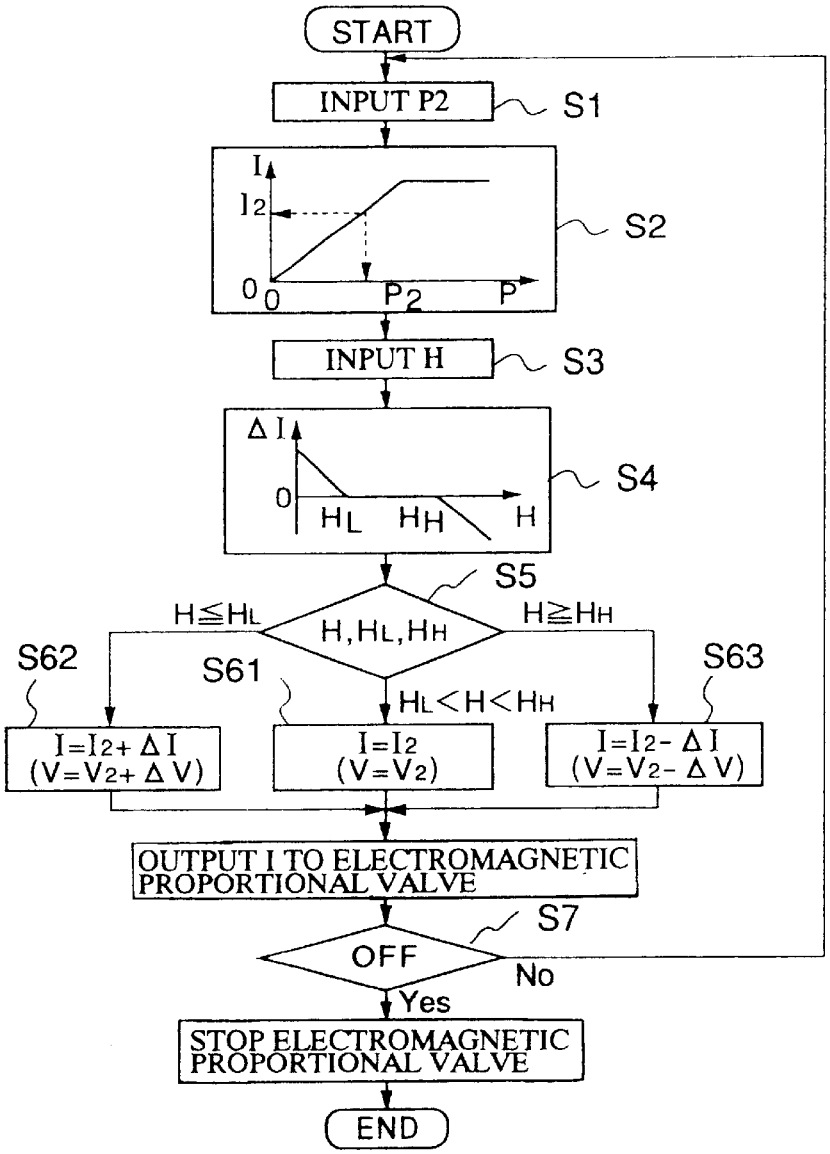
FIG. 5 is a flowchart in the first embodiment of the present invention.
FIG. 6 is a diagram showing a control result of a driving speed of a feeder in the first embodiment of the present invention.
Figure 7:
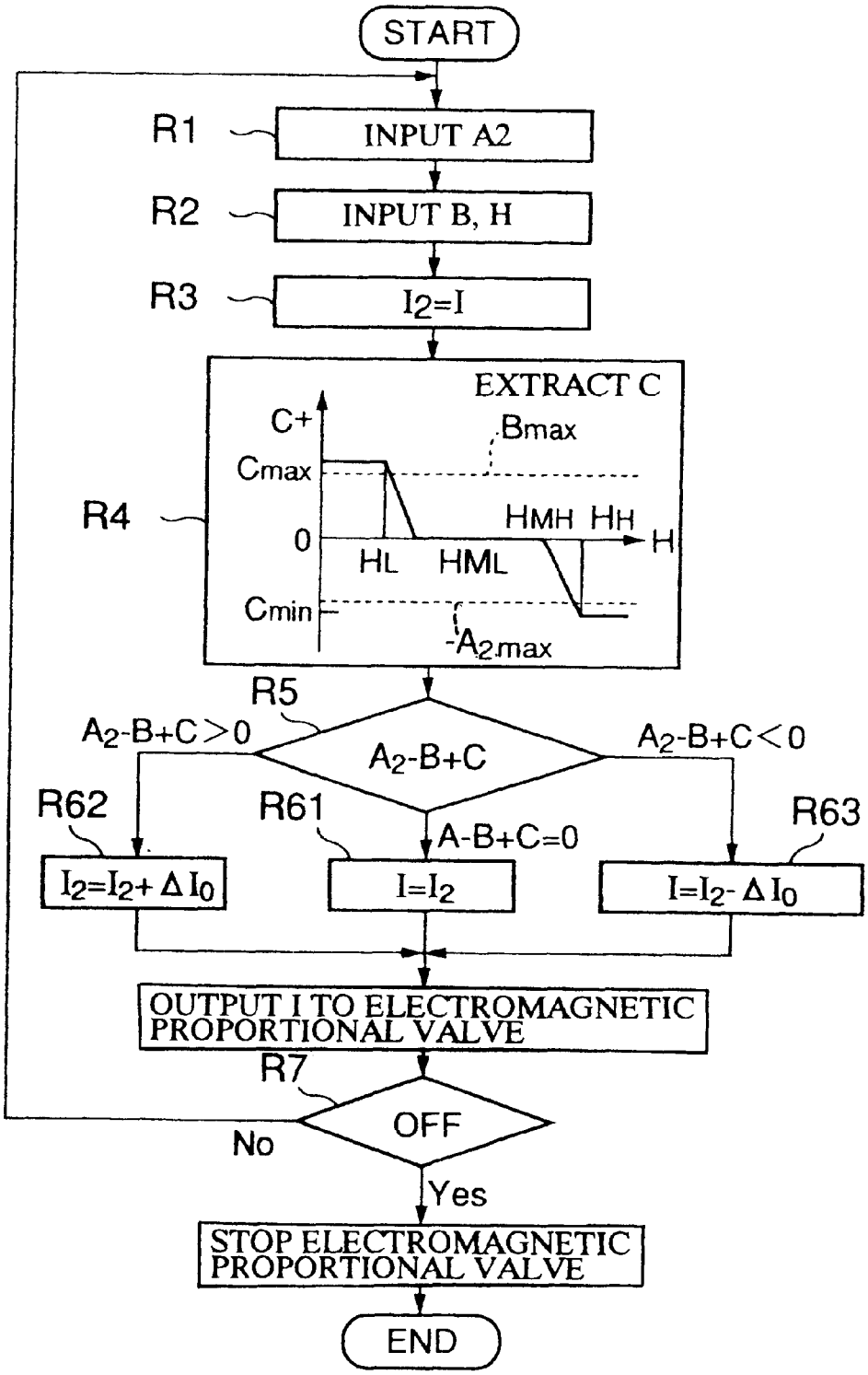
FIG. 7 is a flowchart in a second embodiment of the present invention.
Figure 9:
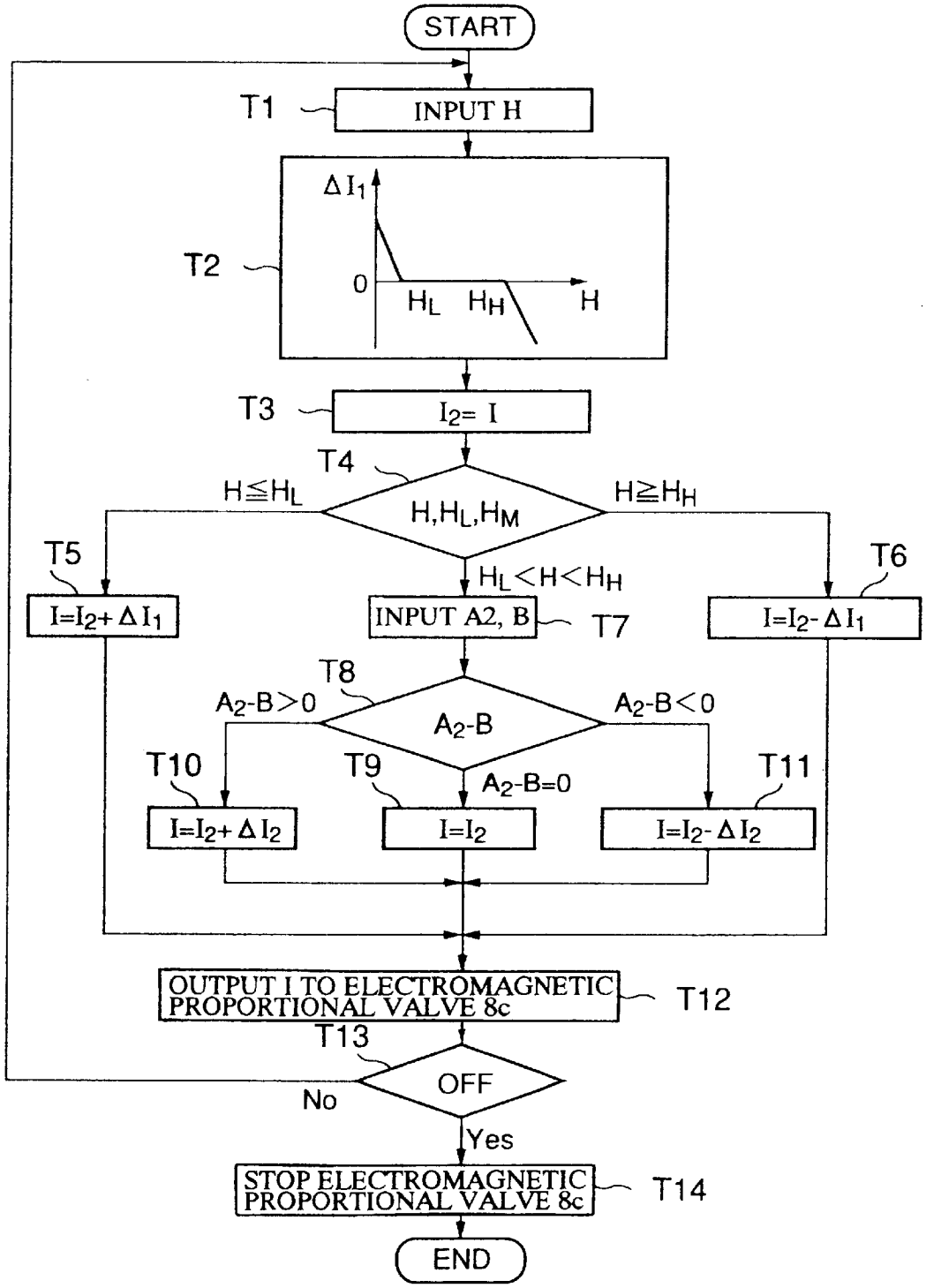
FIG. 9 is a flowchart in a third embodiment of the present invention.

As also shown in FIG. 6, if the comparison result is "HL<H<HH", the reference driving current I2 is maintained (I=I2), and the driving speed V2 of the feeder 3 is maintained (V=V2) (step S61). If "H≦HL", the current +ΔI is added to the reference driving current I2 (I=I2+ΔI), and the driving speed V of the feeder 3 is increased (V=V2+ΔV) (step S62). On the other hand, if "H≧HH", the current −ΔI is added to the reference driving current I2 (I=I2−ΔI), and the driving speed V of the feeder 3 is decreased (V=V2−ΔV) (step S63). Any one of the above steps S1 to S5, and steps S61 to S63 is performed until the positional signal P2 does not exist (for example, until the feeder reference speed setting dial 9 is in the OFF position) (step S7).

The example machine in the second embodiment is constructed by including the detector 7 for detecting the amount of the material to be crushed, the feeder driving system 8, the controller 10, a target crushing amount setting dial (target crushing amount setting means) 11, and an actual crushing amount detector (actual crushing amount detecting means) 12. The differences from the above first embodiment are as in the following [1] to [3].

[1] The target crushing amount setting dial 11 has an OFF position and a non-step position Ai from small amount to large amount, and is made switchable by manipulation of an operator. The target crushing amount setting dial 11 inputs nothing to the controller 10 at the stopping position OFF, while at the non-step position Ai, it inputs a positional signal Ai (for example, a positional signal A2) corresponding to its position. Hereinafter, in order to simplify the explanation, it is assumed that the non-step position Ai of the target crushing amount setting dial 11 is in the position A2 and that the positional signal A2 is inputted to the controller 10 as described above. Following the setting or the setting of the change of the target crushing amount A2 by means of the target crushing amount setting dial 11, the driving speed V of the feeder 3 corresponding to such setting is required, and the driving speed V is set by adding ±ΔI0 to the driving current I at the time. The current ±ΔI0 may be a fixed value, or a variable value corresponding to "A2−B+C (C is a correction amount described later)". Here, if "A2−B+C=0", the current ±ΔI0 is set at 0, and if "A2−B+C>0", the current ±ΔI0 is gradually increased as the "A2−B+C" increases, while if "A2−B+C<0", the current ±ΔI0 is changed to approach 0 as "A2−B+C" approaches 0, thereby producing the operational effect of the relationship rapidly converging on the relationship "A2−B+C=0" (specifically "±ΔI0=0"), in other words, the relationship "B=A2 +C". Specifically, the controller 10 outputs the driving current I at the time to the electromagnetic proportional valve 8*c*.

[2] The actual crushing amount detector 12 is a load sensor or the like provided at the belt conveyor 5, for measuring an actual crushing amount B per unit time (for example, per one minute) and inputting it to the controller 10. It may be suitable if the controller 10 receives a detected load from the load sensor and computes the actual crushing amount B per unit time.

Figure 1A:
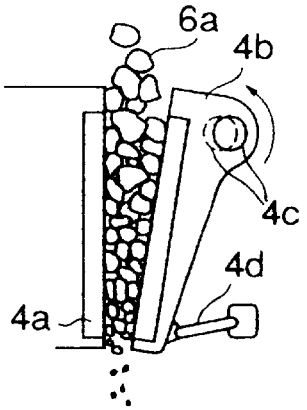
FIG. 1A to FIG. 1C are explanatory views of an operation of a jaw crusher.
Figure 1B:
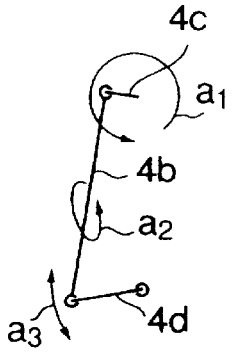
Figure 1C:
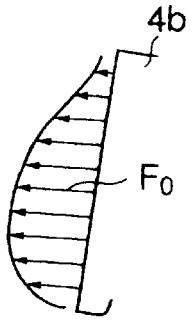
Figure 2A:
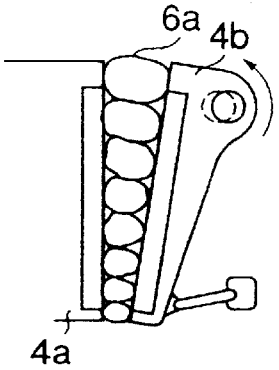
FIG. 2A to FIG. 2C are the other explanatory views of a jaw crusher.
Figure 2B:
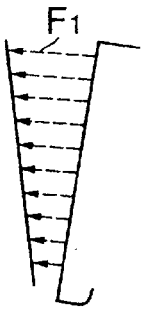
Figure 2C:
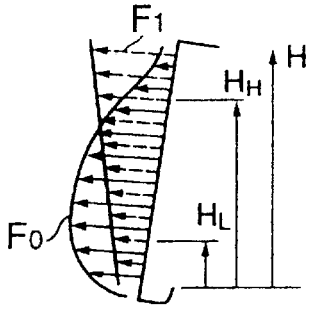
Figure 3:
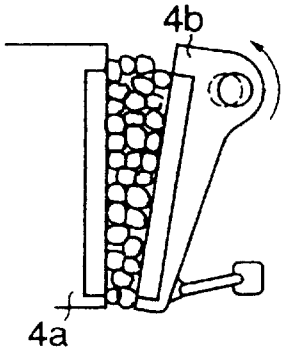
FIG. 3 is an explanatory view of another operation of the jaw crusher.

[3] The controller 10 previously memorizes the crushable amount per unit time (for example, per one minute) of the crusher member 4 according to each position of the positional signal Ai as a target crushing amount Ai. The controller 10 has "the memory regarding the correction amount ±C which determines the magnitude of a change amount ±ΔI of the driving current I". Specifically, in the second embodiment, the "relationship between the height H and the magnitude of the current ±ΔI" described in the step S4 in the first embodiment, and the "input of the positional signal P2 into the controller 10" described in step S1 are not memorized. A control of the second embodiment will be explained below with reference to a flowchart in FIG. 7. The height H of the material 6*a* to be crushed is explained with reference to the bottom portion of the crusher member 4 as shown in FIG. 2 (C).

The controller 10 in the second embodiment receives the target crushing amount A2 from the target crushing amount setting dial 11 (step R1). The controller 10 then receives the actual crushing amount B from the actual crushing amount detector 12 and also receives the height H of the material 6*a* to be crushed inside the crusher member 4 from the detector 7 for detecting the amount of the material to be crushed (step R2). At this point of time, the controller 10 memorizes the driving current I. For convenience in the explanation, the driving current I to be memorized is called "I2" to correspond to the target crushing amount A2 (step R3). The controller 10 previously memorizes the relationship between the height H and the magnitude of the current ±ΔI by means of a function, matrix, and the like as follows. In the concrete example in FIG.7, the controller memorizes four large and small reference values HL, HML, HMH, and HH, regarding the height H (HL<H<ML<HMH<HH), when "H≦HL", the controller 10 memorizes a fixed correction amount +Cmax, when "HL<H≦HML", it memorizes a correction amount +C gradually increasing as the height H decreases, when "HMH≦H<HH", it memorizes a correction amount −C gradually increasing as the height H increases, and when "H≧HH", it memorizes a fixed correction amount −Cmin. The controller 10 compares the height H from the detector 7 for detecting the amount of the material to be crushed and the reference values HL, HML, HMH, and HH, and extracts the correction amount ±C from the memory (step R4).

The controller 10 computes the actual crushing amount B and the correction amount ±C as "A2−B+C=D", and determines whether a resultant value D is plus or minus, or zero (step R5). As also shown in FIG. 8, if the determination result is "D=0", the driving current I2 at this point of time is maintained (I=I2), and the driving speed V2 of the feeder 3 is maintained (V=V2) (step R61). If "D>0", the current +ΔI0 is added to the driving current I2 at this point of time (I=I2+Δ10), and the driving speed V2 of the feeder 3 is increased (V=V2+ΔV0) (step R62). On the other hand, if "D<0", the current −ΔI0 is added to the driving current I2 at this point of time (I=I2−I0), and the driving speed V2 of the feeder 3 is decreased (V=V2−ΔV0) (step R63). Any one of the steps R1 to R5 and the steps R61 to R63 is carried out until the positional signal A2 does not exist (for example, until the target crushing amount setting dial 11 is in the OFF position) (step R7).

The example machine in the third embodiment has the same control system as in the second embodiment. A control of the third embodiment will be explained with reference to a flowchart in FIG. 9. The controller 10 receives the height H of the material 6*a* to be crushed inside the crusher member 4 from the detector 7 for detecting the amount of the material to be crushed (step T1). As in step S4 of the first embodiment, the controller 10 previously memorizes the relationship between the height H and the magnitude of the current ±ΔI1, and the corresponding current ΔI1 from the height H inputted in step T1 (step T2). The controller 10 memorizes the driving current I of the feeder 3 at this point of time (called "I2" as in the second embodiment) (step T3).

The controller 10 compares the height H it receives in step T1 with the reference values HL and HH (step T4). As also shown in FIG. 10, if the comparison result is "H≦HL", the current ΔI1 is added to the driving current I2 at this point of time (I=I2+A I1), and the driving speed V2 of the feeder 3 is increased (V=V2+ΔV1) (step T5). On the other hand, if "H≧HH", the current −ΔI1 is added to the driving current I2 at this point of time (I=I2−ΔI1), and the driving speed V2 of the feeder 3 is decreased (V=V2−ΔV1) (step T6).

If "HL<H<HH", the following processing is performed. The controller 10 receives the target crushing amount A2 from the target crushing amount setting dial 11, and receives the actual crushing amount from the actual crushing amount detector 12 (step T7). The controller 10 computes the target crushing amount A2 and the actual crushing amount B as "A2−B=E", and determines whether a resultant value E is plus or minus, or zero (step T8). As also shown in FIG. 10, if "E=0", the driving current I2 at this point of time is maintained (I=I2), and the driving speed V2 of the feeder 3 is maintained (V=V2) (step T9, step T12). If "E>0", the current +ΔI2 is added to the driving current I2 at this point of time (I=I2+ΔI2), and the driving speed V2 of the feeder 3 is increased (V=V2+ΔV2) (step T10, step T12). On the other hand, if "E<0", the current −ΔI2 is added to the driving current I2 at this point of time (I=I2−ΔI2), and the driving speed V2 of the feeder 3 is decreased (V=V2−ΔV2) (step T11, step T12).

The current ±ΔI2 may also be a fixed value, or a variable value corresponding to "A2−B". Here, if "A2−B=0", the current ±ΔI2 is set at zero, and if "A2−B>0", the current ±ΔI2 is gradually increased as the "A2−B" increases, while if "A2−B<0", the current ±ΔI2 is changed to approach zero as "A2−B" approaches zero, thereby producing the operational effect of the relationship rapidly converging on the relationship "A2−B=0" (specifically "+ΔI2=0"), in other words, the relationship "B=A2". The above steps T1 to T12 are performed until the positional signal A2 doesn't exist (for example, until the target crushing amount setting dial 11 is in the OFF position) (step T13, step T14)

Other embodiments will be described below.

(1) The example machines being the above first, second and third embodiments are each described as a mobile crusher having the jaw crusher member 4 as in FIG. 11, but they may each have an impact type or a shear type of crusher member 4. In this case, if the height H of the material 6*a* to be crushed inside the crusher member 4 is detected, it can be handled as in the aforementioned first and second embodiment.

(2) The detector 7 for detecting the amount of the material to be crushed in the aforementioned first, second and third embodiment is placed at the position at which ultrasonic waves are not emitted to the material 6*a* to be crushed which are falling into the crusher member 4 from the feeder 3, but it may be placed so that the ultraviolet waves are emitted to the material 6*a* to be crushed which are falling. In this case, it is desired that the controller 10 contains a low-pass filter, an arithmetic circuit and the like as follows. The height H of the material 6*a* to be crushed falling into the crusher member 4 from the feeder 3 is an alternating-current component, since it varies according to the magnitude and the amount of the falling movement and the material 6*a* to be crushed. Compared with this, the height H of the material 6*a* to be crushed inside the crusher member 4 is a direct-current component, since it is approximately fixed. Accordingly, with use of the low-pass filter, the height H of the material 6*a* to be crushed inside the crusher member 4, which is approximately a direct-current component can be detected. The frequency of the detection of the height H of the material 6*a* to be crushed falling into the crusher member 4 from the feeder 3 varies according to the magnitude and the amount of the falling movement and the material 6*a* to be crushed, but compared with this, the number of the occurrence of the height H of the material 6*a* to be crushed inside the crusher member 4 is approximately fixed. Consequently, by including an arithmetic circuit for extracting the height H with the number of occurrence being continuous, the height H of the material 6*a* to be crushed inside the crusher member 4 can be computed. With use of a circuit with low degree of sensitivity, or with a low computing speed, the height H of the material 6*a* to be crushed inside the crusher member 4 can be detected. The feeder 3 is a feeder driven in an X direction, but it may be a vibrating feeder vibrating in the directions other than the X direction.

(3) The absolute value of the current ±ΔI in the first embodiment is gradually increased, but each value may be a fixed value. By setting it to be a fixed value, the control is facilitated.

(4) In the aforementioned second embodiment, the controller memorizes four large and small reference values HL, HML, HMH, and HH, (HL<HML<HMH<HH), and when "H≦HL", the controller 10 memorizes a fixed correction amount +Cmax, when "HL<H<HML", it memorizes a correction amount +C gradually increasing as the height H decreases, when "HMH≦H<HH", it memorizes a correction amount −C gradually increasing as the height H increases, and when "H≧HH", it memorizes a fixed correction amount−Cmin, however, the following may be suitable. Specifically, when "HL<H ≦HML" and "HMH≦H<HH", the correction amounts +C and −C are set to be zero, and with two small and large reference values HL and HH (HL<HH), in "H≦HL", even if the controller 10 memorizes the fixed correction amount +Cmax, and in "H≧HH", even if the controller 10 memorizes the fixed correction amount −Cmin, the operational effects are almost the same as in the second embodiment.

(5) In the embodiment in the aforementioned item (4), the correction amount Cmax may be set to be larger than the maximum value of the actual crushing amount B, and the absolute value of the correction amount −Cmin may be set to be larger than the target crushing amount A2. By this setting, the operational effects in the aforementioned second embodiment, (a) when "H≦HL", the driving speed V of the feeder 3 increases, (b) when "HL<H<HH", the driving speed V of the feeder 3 is maintained, and (c) when "H≧HH", the driving speed of the feeder is decreased, thus facilitating the control.

INDUSTRIAL AVAILABILITY

The present invention is useful as a mobile crusher which has a high-quality controlling function enabling an efficient production, and which is capable of preventing the crusher itself and the like from being damaged by preventing the occurrence of an anomaly.

What is claimed is:

1. A mobile crusher including a feeder and a crusher member each set drivably on a mobile vehicle body, which feeds a material to be crushed, which is placed on said feeder from an outside, into an inside of said crusher member from an upper opening of said crusher member by drive of said feeder, crushes the same by drive of said crusher member, and discharges a crushed material from a lower opening of said crusher member to the outside, said mobile crusher further comprising:

(a) target crushing amount setting means for setting a target crushing amount A2 per unit time of said crusher member;

(b) actual crushing amount detecting means for detecting an actual crushing amount B per unit time of said crusher member;

(c) means for detecting an amount of a material to be crushed, which detects an amount H of the material to be crushed inside said crusher member; and (d) control means for receiving a target crushing amount A2 from said target crushing amount setting means, an actual crushing amount B from said actual crushing amount detecting means, and the amount H from said means for detecting the amount of the material to be crushed, and controlling a driving speed V of said feeder changeably based on said reception amounts A2, B and H.

2. A mobile crusher including a feeder and a crusher member each set drivably on a mobile vehicle body, which feeds a material to be crushed, which is placed on said feeder from an outside, into an inside of said crusher member from an upper opening of said crusher member by drive of said feeder, crushes the same by drive of said crusher member, and discharges a crushed material from a lower opening of said crusher member to the outside, said mobile crusher further comprising:

(a) target crushing amount setting means for setting a target crushing amount A2 per unit time of said crusher member;

(b) actual crushing amount detecting means for detecting an actual crushing amount B per unit time of said crusher member;

(c) means for detecting an amount of a material to be crushed, which detects an amount H of the material to be crushed inside said crusher member; and (d) control means for previously memorizing reference values HML and HMH, (d11) a correction amount +C which is set correspondingly to a value not more than the reference value HML, (d12) a correction amount C (=0) which corresponds to a value between the reference values HML and HMH, and (d13) a correction amount −C which is set correspondingly to a value not less than the reference value HMH, receiving a target crushing amount A2 from said target crushing amount setting means, an actual crushing amount B from said actual crushing amount detecting means, and the amount H from said means for detecting the amount of the material to be crushed, (d21) when "H≦HML", reading said set correction amount +C, (d22) when "HML<H<HMH", reading said corresponding correction amount C (=0), and (d23) when "H≧HMH", reading said correction amount −C, previously memorized, and computing "A2−B+the correction amount=D", and (d31) when "D>0", inputting a signal +ΔI0 to increase a driving speed V of said feeder to a feeder driving system, (d32) when "D=0", inputting a signal I2 to maintain said driving speed V to the feeder driving system, and (d33) when "D<0", inputting a signal −ΔI0 to decrease said driving speed V to the feeder driving system.

3. A mobile crusher including a feeder and a crusher member each set drivably on a mobile vehicle body, which feeds a material to be crushed, which is placed on said feeder from an outside, into an inside of said crusher member from an upper opening of said crusher member by drive of said feeder, crushes the same by drive of said crusher member, and discharges a crushed material from a lower opening of said crusher member to the outside, said mobile crusher further comprising:

(a) target crushing amount setting means for setting a target crushing amount A2 per unit time of said crusher member;

(b) actual crushing amount detecting means for detecting an actual crushing amount B per unit time of said crusher member;

(c) means for detecting an amount of a material to be crushed, which detects an amount H of the material to be crushed inside said crusher member; and (d) control means for previously memorizing reference values HL and HH, receiving the target crushing amount A2 from said target crushing amount setting means, the actual crushing amount B from said actual crushing amount detecting means , and the amount H from said means for detecting the amount of the material to be crushed, comparing the amount H with the reference values HL and HH, and (d21) when "H≦HL", inputting a signal +ΔI1 to increase the driving speed V of said feeder to a feeder driving system, (d22) when "HL<H<HH", computing "A2−B=E", and (d221) when "E>0", inputting a signal +ΔI2 to increase said driving speed V to the feeder driving system, (d222) when "E=0", inputting a signal I2 to maintain said driving speed V to the feeder driving system, and (d223) when "E<0", inputting a signal −ΔI2 to decrease said driving speed V to the feeder driving system, and (d23) when "H≧HH", inputting a signal −ΔI1 to decrease said driving speed V to the feeder driving system.

4. A mobile crusher including a feeder and a crusher member, each set drivably on a mobile vehicle body, which feeds a material to be crushed, which is placed on said feeder from an outside, into an inside of said crusher member from an upper opening of said crusher member by drive of said feeder, crushes the same by drive of said crusher member, and discharges a crushed material from a lower opening of said crusher member to the outside, said mobile crusher further comprising:

(a) means for detecting an amount of a material to be crushed, which detects an amount H of the material to be crushed inside said crusher member; and (b) control means for previously memorizing reference values HL and HH, receiving the amount H from said means for detecting the amount of the material to be crushed, comparing the amount H with the reference values HL and HH, and (b1) when "$H \leqq HL$", inputting a signal $+\Delta I$, which gradually increases according to a value of "HL−H" and which is a signal to increase a driving speed V of said feeder, to a feeder driving system, (b2) when "$HL < H < HH$", inputting a signal I2 to maintain said driving speed V to the feeder driving system, and (b3) when "$H \geqq HH$", inputting a signal $-\Delta I$, which gradually increases according to a value "H−HH" and which is a signal to decrease said driving speed V, to the feeder driving system.

* * * * *